US006247465B1

(12) United States Patent
Sprunger

(10) Patent No.: US 6,247,465 B1
(45) Date of Patent: Jun. 19, 2001

(54) SYSTEM AND METHOD FOR PREVENTING SPARK-ON-MAKE IN AN INTERNAL COMBUSTION ENGINE USING MANIFOLD PRESSURE

(75) Inventor: Douglas Lynn Sprunger, Middletown, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/502,751

(22) Filed: Feb. 11, 2000

(51) Int. Cl.[7] ..... F02P 3/045
(52) U.S. Cl. ..... 123/609; 123/625; 123/645
(58) Field of Search ..... 123/609, 610, 123/625, 630, 644, 645

(56) References Cited

U.S. PATENT DOCUMENTS 4,774,925 * 10/1988 Iwata ..... 123/644
4,886,037 * 12/1989 Schleupen ..... 123/644 X
4,969,447 * 11/1990 Di Nunzio et al. ..... 123/645
5,127,388 * 7/1992 Cicalese et al. ..... 123/644
5,586,542 * 12/1996 Taruya et al. ..... 123/645 X
5,967,128 * 10/1999 Onuki et al. ..... 123/644

* cited by examiner

*Primary Examiner*—Tony M. Argenbright
(74) *Attorney, Agent, or Firm*—Margaret A. Dobrowitsky

(57) ABSTRACT

A system is provided for preventing spark-on-make in an internal combustion engine, using manifold pressure information. The system includes a pressure sensor and a controller. The pressure sensor is adapted to detect pressure in an intake manifold and provide an output signal indicative of that pressure. The controller is at least indirectly connected to the pressure sensor and is adapted to delay initiation of ignition dwell in a coil by a period of time sufficient to avoid spark-on-make, in response to the output signal from the sensor. Preferably, the pressure sensor is a manifold absolute pressure (MAP) sensor. The controller preferably is implemented by suitably programming or otherwise configuring an electronic engine control unit (ECU). Also provided is a method for preventing spark-on-make in an internal combustion engine.

28 Claims, 4 Drawing Sheets

SYSTEM AND METHOD FOR PREVENTING SPARK-ON-MAKE IN AN INTERNAL COMBUSTION ENGINE USING MANIFOLD PRESSURE

BACKGROUND OF THE INVENTION

1. Field of the Invention

The present invention relates to a system and method for preventing spark-on-make in an internal combustion engine, using manifold pressure information.

2. Discussion of the Related Art

A typical automotive ignition system includes a spark plug for each combustion chamber of an engine, at least one ignition coil and at least one device adapted to selectively charge the coil(s) and cause the energy stored in the coil(s) to be discharged through the spark plugs in a timed manner. As a result, a spark is generated and ignition of a fuel-air mixture in each combustion chamber occurs at a specified timing.

When charging of the coil is initiated, however, a transient voltage is created. In some situations, this transient voltage may be high enough to create a spark at the spark plug. This kind of sparking event is commonly referred to as a spark-on-make event or condition because historically it would occur when the breaker points of the ignition system made contact to commence charging of the ignition coil. The term "spark-on-make", as used in this disclosure however, is not limited to situations where conventional breaker points are used. To the contrary, it refers to any situation where initiation of coil or ignition system charging causes a spark at one or more of the spark plugs. This kind of sparking event, however, is undesirable because it is not timed for proper engine operation. It can cause severe damage to engine components.

Recent advances in technology have made it more practical and desirable in some situations to provide a coil-per-cylinder ignition arrangement (i.e., wherein a coil is provided for each cylinder of the engine). While the coil-per-cylinder arrangements provide some benefits and advantages, the spark-on-make condition is more likely to occur in such an arrangement. The spark-on-make conditions or events, as a result, tend to detract from the benefits achieved by providing a coil from each cylinder.

Efforts therefore have been directed at eliminating or reducing the likelihood that a spark-on-make event will occur. While conventional techniques of avoiding the spark-on-make condition can be generally effective, there is significant room for improvement. Many such techniques involve complicated and/or time-consuming manufacturing and/or installation processes, and/or involve customized or otherwise relatively expensive parts. The conventional techniques therefore can be relatively expensive, complicated, and time-consuming.

Examples of the conventional techniques of avoiding a spark-on-make condition include 1) providing a high voltage diode that is used to permit the flow of current in one direction to the spark plug but not in the reverse direction, thereby allowing the coil to be discharged after sufficient charging and at the proper time while preventing application of the transient voltage created during initiation of the charging process, and 2) by reducing the number of turns in the coil.

The first technique is relatively expensive. A high voltage diode can cost several cents per diode, even when purchased as part of a high volume transaction. In automotive manufacturing, where the number of parts and the cumulative cost thereof can escalate, a per-part cost of several cents should be avoided whenever possible. In addition, the use of a high voltage diode is not always compatible with ignition systems that have ion sense capabilities. Typically, the way to provide compatibility of the high voltage diode technique with ignition systems that have ion sense capabilities is to use a positive polarity spark. It is more desirable, however, to not be limited to use of such positive polarity sparks because they have a higher demand voltage (e.g., 10% higher).

The second technique, namely, reducing the number of turns in the secondary winding of the coil disadvantageously tends the increase the overall cost of the coil driving electronics. In some cases, the reduction in number of turns also prevents the coil from satisfying other requirements imposed by the consumer (e.g., an engine or ignition system manufacturer).

There is consequently a need in the art for a less complicated, less expensive, more reliable, and/or more practical system and method for preventing spark-on-make in an internal combustion engine. This need extends to a system and method that is not limited to use on positive spark polarity ignition systems.

SUMMARY OF THE INVENTION

It is a primary object of the present invention to overcome at least one of the foregoing problems and/or to satisfy at least one of the aforementioned needs by providing a more practical, less expensive, more reliable, and/or less complicated system and method for preventing spark-on-make in an internal combustion engine.

To achieve this and other objects and advantages, the present invention provides a system and method for preventing spark-on-make in an internal combustion engine, using manifold pressure information. The system comprises a pressure sensor and a controller. The pressure sensor is adapted to detect pressure in an intake manifold and provide an output signal indicative of that pressure. The controller is at least indirectly connected to the pressure sensor and is adapted to delay initiation of ignition dwell in a coil by a period of time sufficient to avoid spark-on-make, in response to the output signal from the sensor. Preferably, the pressure sensor is a manifold absolute pressure (MAP) sensor. In addition, the controller preferably is adapted to calculate, based on a present value of a supply voltage, a make voltage level that would be developed across a secondary winding of the ignition coil upon connection of the supply voltage to a primary winding of the ignition coil. Preferably, the controller is associated with a memory, the memory containing a plurality of tables, each table being associated with a respective value or range of values of the pressure and containing a plurality of safety voltage maximum levels, each safety voltage maximum level being correlated in each table to an earliest safe crank angle value at which dwell can be commenced without causing the make voltage to exceed the correlated safety voltage maximum level. Each safety voltage maximum level in each table preferably is less than the spark demand voltage by a predetermined safety margin at a respective pressure and at the earliest safe crank angle correlated to that safety voltage maximum level. The controller also can be adapted to access, based on the output signal, one of the tables that corresponds to the present value of the pressure, and to access, within that table and based on the make voltage level calculated by the controller, the earliest safe crank angle value at which dwell can be commenced without causing the make voltage to exceed the correlated safety voltage maximum level. The controller also can be adapted to prevent initiation of dwell until the crank angle indicated by the earliest safe crank angle value selected by accessing the tables using the make voltage level, is reached.

Also provided by the present invention is a method for preventing spark-on-make in an internal combustion engine. The method comprises the steps of detecting pressure in an intake manifold, providing an output signal indicative of that pressure, and delaying initiation of ignition dwell in an ignition coil by a period of time sufficient to avoid spark-on-make, in response to the output signal. The pressure preferably is a manifold absolute pressure (MAP).

Preferably, the step of delaying includes calculating, based on a present value of a supply voltage, a make voltage level that would be developed across a secondary winding of the ignition coil upon connection of the supply voltage to a primary winding of the ignition coil; providing a plurality of tables, each table being associated with a respective value or range of values of the manifold pressure and containing a plurality of safety voltage maximum levels, each safety voltage maximum level being correlated in each table to an earliest safe crank angle value at which dwell can be commenced without causing the make voltage to exceed the correlated safety voltage maximum level, each safety voltage maximum level in each table being less than the spark demand voltage by a predetermined safety margin at a respective pressure and at the earliest safe crank angle correlated to that safety voltage maximum level; accessing, based on the output signal, one of the tables that corresponds to the present value of the pressure; accessing, within that table and based on the make voltage level, the earliest safe crank angle value at which dwell can be commenced without causing the make voltage to exceed the correlated safety voltage maximum level; and preventing initiation of dwell until the crank angle indicated by the earliest safe crank angle value selected by accessing the aforementioned one of the tables using the make voltage level, is reached. Preferably, the method is performed by an electronic engine control unit (ECU) and the tables are stored in an electronic memory associated therewith or internal thereto.

Also provided by the present invention is a system for preventing spark-on-make in an internal combustion engine, the system comprising means for detecting pressure in an intake manifold and providing an output signal indicative of that pressure, and means for delaying initiation of ignition dwell of an ignition coil by a period of time sufficient to avoid spark-on-make, in response to the output signal.

Still other objects, advantages, and features of the present invention will become more readily apparent when reference is made to the accompanying drawing and the associated description contained herein.

DESCRIPTION OF PREFERRED EMBODIMENTS

Figure 1:
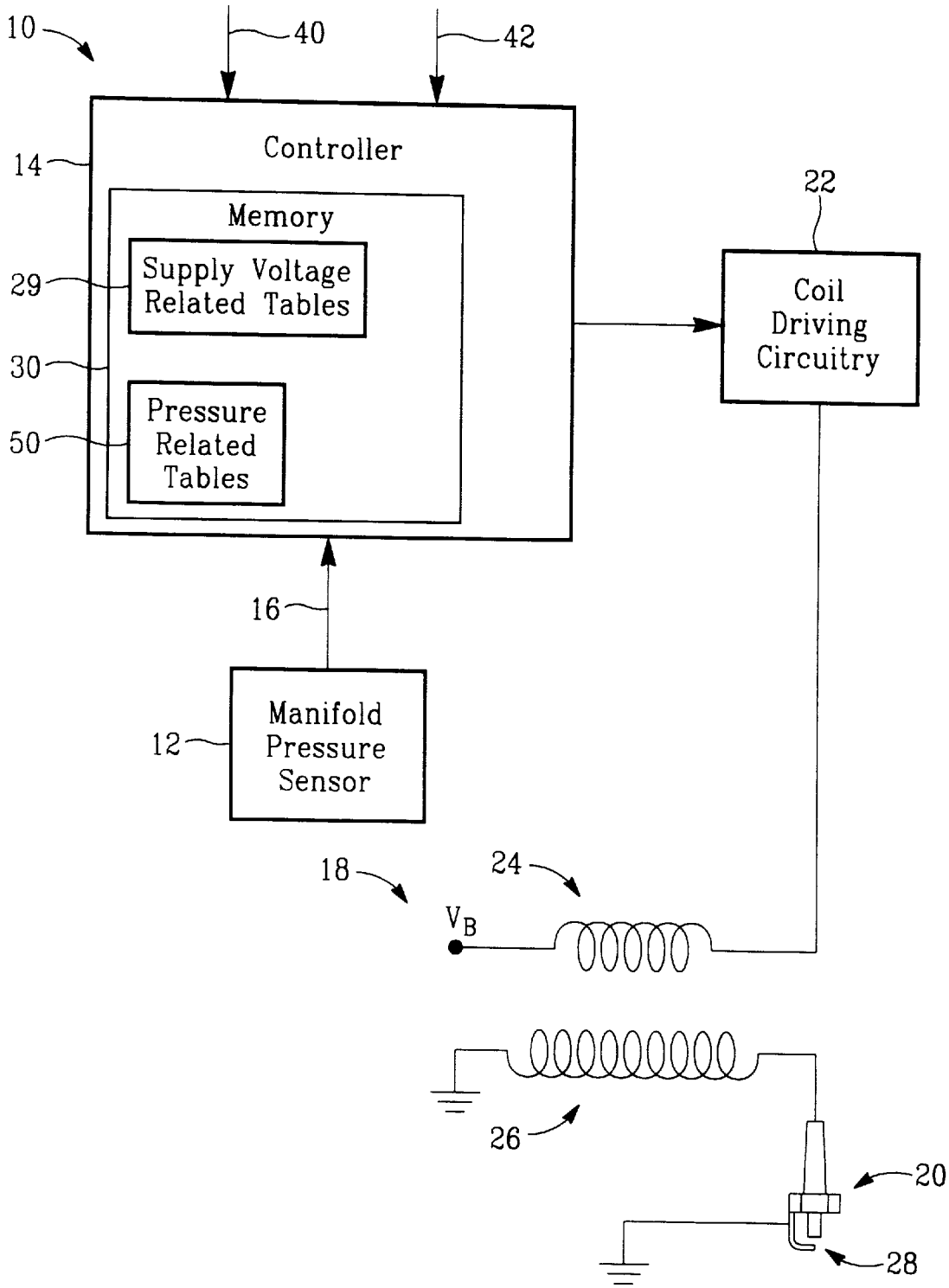
FIG. 1 is a block diagram of a system for preventing spark-on-make according to a preferred embodiment of the present invention.

FIG. 1 illustrates a system 10 for preventing spark-on-make in an internal combustion engine, according to a preferred embodiment of the present invention. The system 10 includes a pressure sensor 12 and a controller 14. The pressure sensor 12 is adapted to detect pressure in an intake manifold of the associated engine and is adapted to provide an output signal indicative 16 of that pressure.

The controller 14 is connected, at least indirectly, to the pressure sensor 12. The controller 14 is adapted (by programming or otherwise) to delay initiation of ignition dwell in an ignition coil 18 by a period of time sufficient to avoid spark-on-make. The controller 14 does this in response to the output signal 16 from the sensor 12.

For the sake of simplicity, FIG. 1 shows only one spark plug 20, one ignition coil 18, and one version of the coil driving circuitry 22 that drives the primary winding 24 of the coil 18. It will be appreciated, however, that the typical engine will have more than one combustion chamber, and therefore may have multiple ignition coils 18, spark plugs 20, and/or coil driving circuitry 22. The delay in the initiation of dwell provided by the controller 14 preferably is applied to each such ignition coil 18 of the engine.

It is known in the automotive industry to provide an internal combustion engine with an electronic engine control unit ECU that controls the operation of the engine, transmission, and/or associated elements thereof based upon input signals from a plurality of sensors. One such sensor is the manifold absolute pressure (MAP) sensor. This sensor provides the ECU with a signal indicative of the absolute pressure in the intake manifold of the engine.

Preferably, the aforementioned controller 14 is an ECU that has been programmed or otherwise suitably configured to prevent spark-on-make in accordance with the present invention. The sensor 12 preferably is a conventional manifold absolute pressure (MAP) sensor, the output 16 of which is used by the ECU to determine a delay, if any, in dwell initiation. Hereinafter, the controller 14 will be described as being adapted to perform certain steps and functions. It will be appreciated that the controller 14 and/or ECU can be adapted to perform such steps or functions by programming it or otherwise suitably configuring the controller 14 and/or ECU.

The controller 14 can be adapted to provide the delay in such a way that, when manifold pressure increases according to the output signal 16, the magnitude of the delay generally decreases. Under certain conditions, there may be no delay. When the manifold pressure is high enough, for example, and/or when there is little, if any, need to advance the spark timing, the delay can be eliminated and dwell can commence according to conventional spark timing techniques.

The foregoing relationship between manifold pressure and delay is desirable because the spark demand voltage (i.e., the voltage required across the secondary winding 26 of an ignition coil 18 to generate a spark across the spark plug gap 28) is a function of gas density. Generally, as the compression stroke progresses, the spark demand voltage increases and it is less likely that a spark-on-make event will occur. Likewise, the spark demand voltage tends to increase and it is generally less likely for a spark-on-make event to occur, when intake manifold pressure increases.

Figure 2:
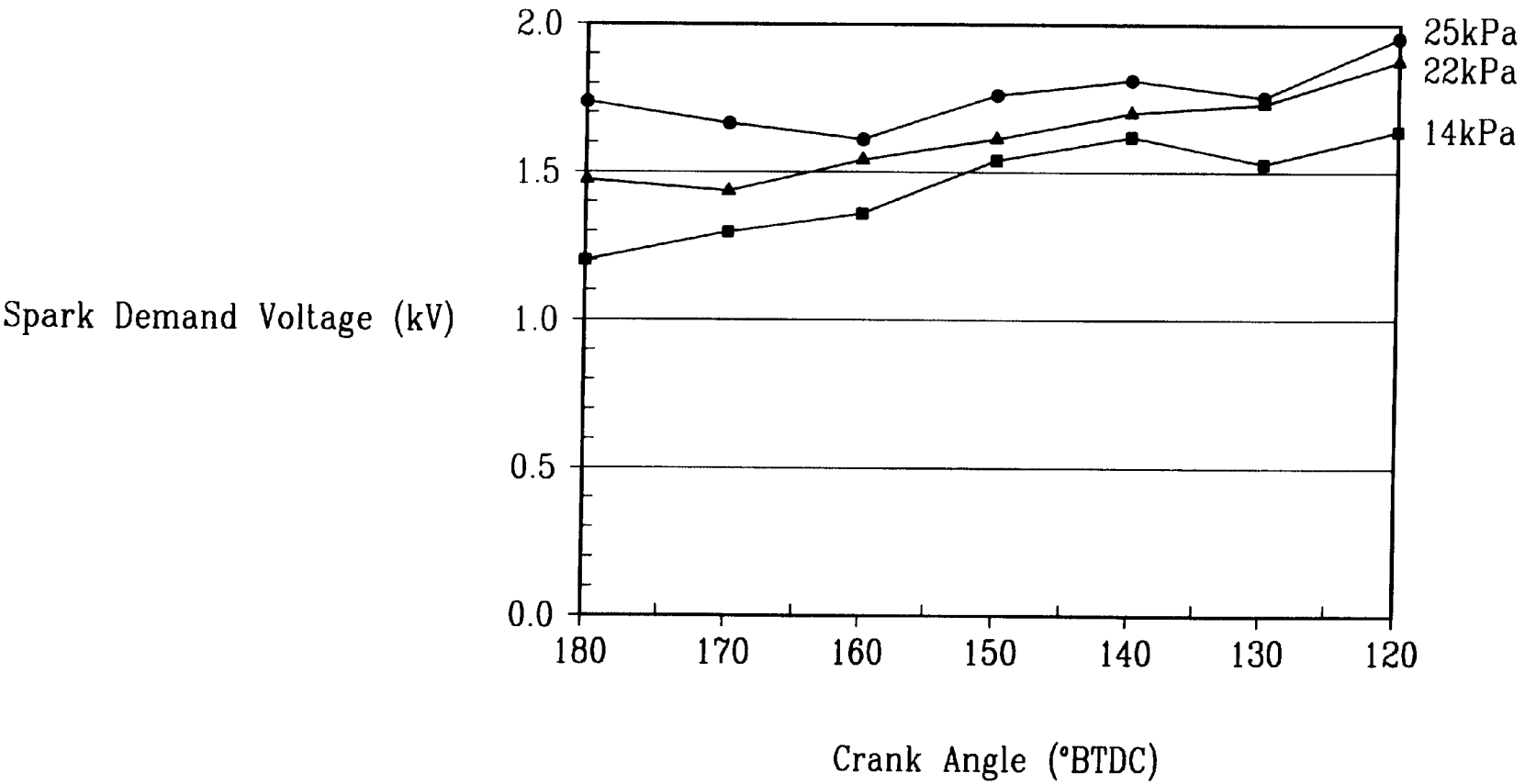
FIG. 2 is a graph of spark demand voltages at different manifold pressures, plotted as a function of engine crank angle before top dead center (BTDC).

FIG. 2 is an exemplary graph of spark demand voltages plotted for different manifold pressures as a function of engine crank angle. As the manifold pressure increases, the spark demand voltage also tends to increase. The spark demand voltage also tends to increase the closer the crank angle gets to top-dead-center (TDC) (i.e., as the compression cycle progresses). Thus, a spark-on-make condition is generally less likely to exist the more the dwell is delayed and the higher the manifold pressure increases. Conversely, there is generally a higher danger of spark-on-make when the manifold pressure is low and dwell is commenced earlier in advance of TDC.

Since a spark-on-make event can have a catastrophic effect on an engine and its associated components, some engine manufacturers and/or ignition system consumers demand a significant safety margin between the spark demand voltage and the voltage (hereinafter "the make voltage") generated across the secondary winding 26 when dwell is commenced. The conventional way of providing this safety margin, however, is to assume a safety margin based solely on the most dangerous spark-on-make conditions and to preclude use of any ignition system designs that have a make voltage within a certain number of volts of the spark demand voltage during that most dangerous spark-on-make condition. The limits on make voltage, in this regard, are conventionally applied "across the board."

From the graph illustrated in FIG. 2, however, it becomes readily apparent that such a conventional approach provides a larger safety margin than is necessary when the operating conditions of the engine are such that dwell commences closer to TDC (i.e., toward the right in FIG. 2) and/or when the manifold pressure is higher (i.e., when the upper plots of spark demand voltage in FIG. 2 are relevant). Some engine manufacturers, for example, mandate that the make voltage not exceed a predetermined fixed voltage to ensure that the make voltage remains well below the lowest possible spark demand voltage for any possible manifold pressures and crank angle combinations, regardless of the actual spark demand voltage at those manifold pressures and crank angles. From FIG. 2, it becomes readily apparent that this provides an unnecessarily large safety margin at higher manifold pressures and/or when the dwell is not significantly advanced (i.e., when the dwell is commenced closer to the right in FIG. 2 (closer to TDC) than the left (much earlier than TDC)). The excessive safety margin comes at a cost in overall performance and/or increased cost for additional and/or more expensive parts.

Figure 3:
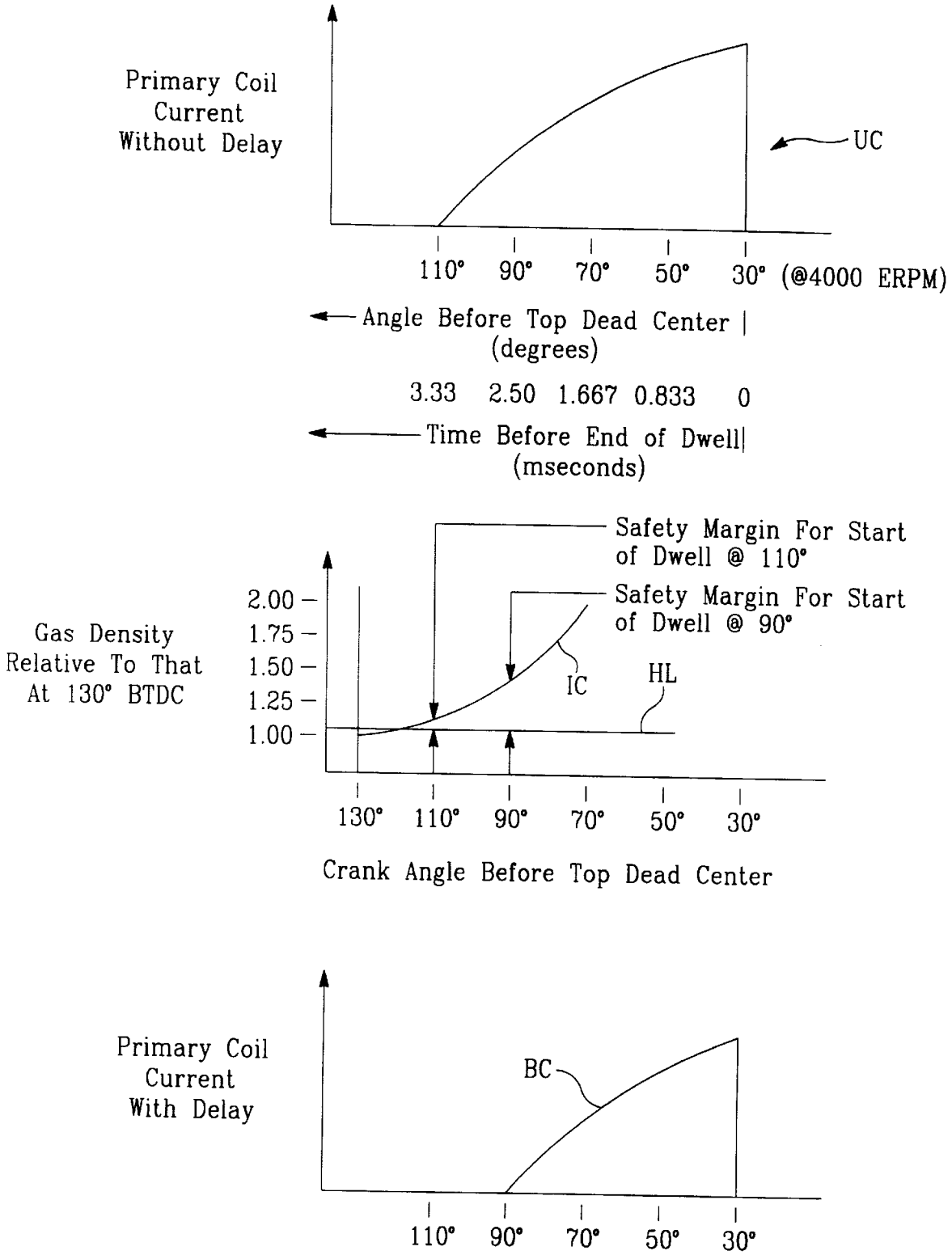
FIG. 3 is a timing diagram wherein the upper curve is an exemplary waveform of the electrical current in the primary winding of an ignition coil when dwell is initiated without delay, wherein the intermediate curve is the gas density relative to the gas density at 130 degrees BTDC as a function crank angle, and wherein the bottom curve is an exemplary waveform of the electrical current in the primary winding of the ignition coil when the initiation of dwell has been delayed according to the present invention.

With reference to FIG. 3, by contrast, the present invention provides a controller 14 that delays the start of dwell, when necessary or desirable, to provide a better safety margin from spark-on-make conditions. The difference in safety margins between the delayed version and the undelayed version of the dwell current is readily apparent from FIG. 3. This delay is provided when the manifold pressure is low and the initiation of dwell would have been so early that there would be a potential danger of a spark-on-make event. Since those conditions typically occur when high engine performance is not critical (e.g., going downhill at high revolutions-per-minute (RPM) with the throttle closed), any loss in engine performance that results from the delay in the initiation of dwell has little, if any, negative impact on perceived engine performance. Since the delay may be absent, or much smaller, at times when engine performance is more important (e.g., at higher manifold pressures), the spark-on-make event can be avoided with little, if any, driver-perceivable impact on engine performance. Moreover, the selective use of delays in the commencement of dwell can be provided, according to the present invention, by suitably programming or configuring an ECU, without the need for any additional or more expensive parts.

FIG. 3 is a timing diagram, at 4,000 engine RPM, wherein the upper curve UC is an exemplary waveform of the electrical current in the primary winding 24 of an ignition coil 18 when dwell is initiated without delay at about 110 degrees before TDC (BTDC), the intermediate curve IC is the gas density relative to the gas density at 130 degrees BTDC as a function crank angle, and the bottom curve BC is an exemplary waveform of the electrical current in the primary winding 24 of the ignition coil 18 when the initiation of dwell has been delayed according to the present invention.

In the exemplary scenario of FIG. 3, the amount of delay is about 20 crank degrees (from 110 degrees BTDC to 90 degrees BTDC). This corresponds to about 0.8333 seconds of delay when the engine is operating at about 4,000 RPM Intersecting the intermediate curve IC is a horizontal line HL. This horizontal line HL represents the density at which the make voltage and the spark demand voltage are equal. From the intermediate curve IC, it becomes readily apparent that the delay in the initiation of dwell provides a correspondingly higher safety margin than without the delay.

By selectively applying the delay when it is needed and increasing its magnitude as the operating conditions of the engine so require, it is possible to avoid a spark-on-make event using higher make voltages than might otherwise be permitted. As indicated above, the ability to use higher make voltages, especially in coil-per-cylinder ignition systems, has a significant impact on reducing the cost of coil driver circuits 22 for the primary winding 24 of the ignition coil 18. Moreover, since the spark-on-make countermeasure is selectively applied when it is most needed, it is possible to provide a smaller safety margin that more closely follows the needs imposed by the engine's operating conditions.

Figure 4:
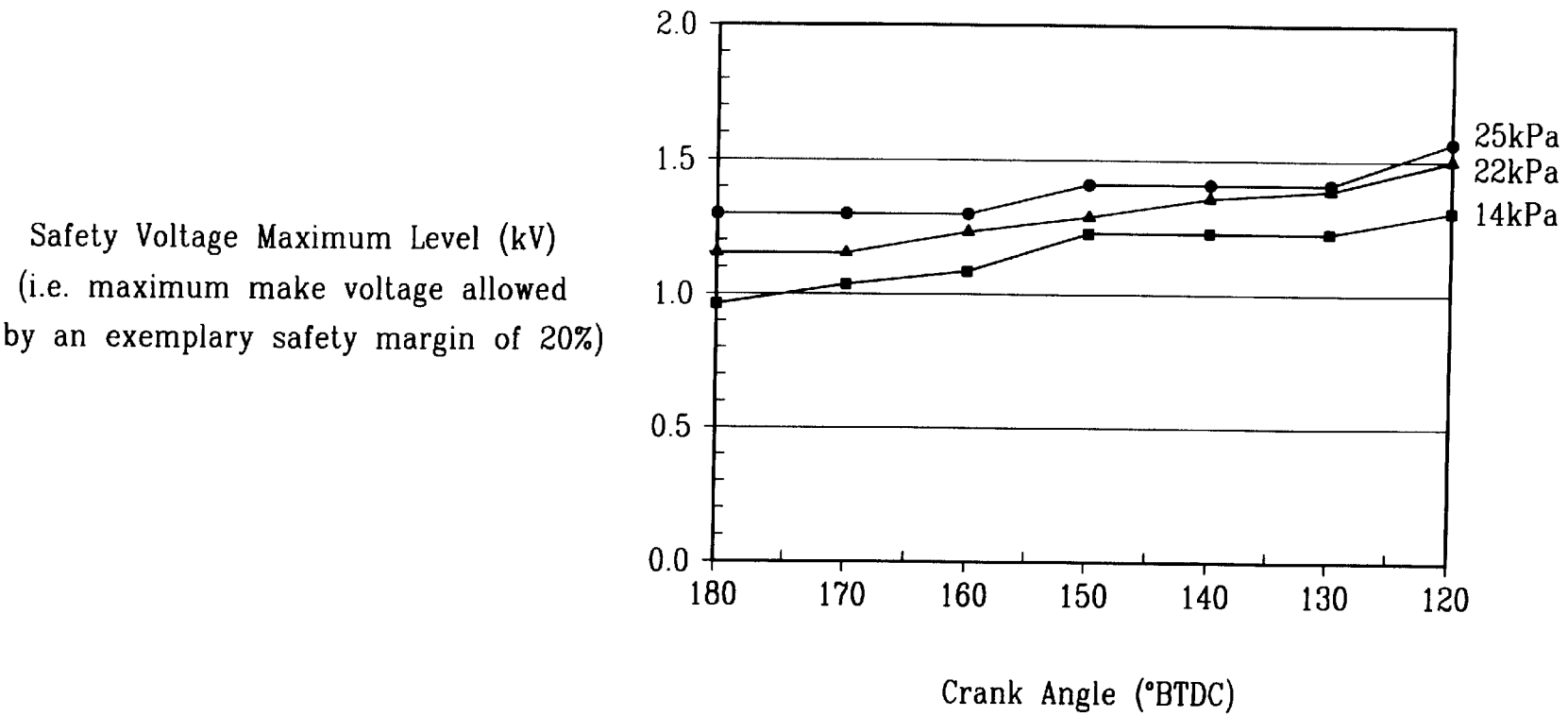
FIG. 4 is a graph of safety voltage maximum levels for different manifold pressures, plotted as a function of engine crank angle before top dead center (BTDC).

With reference to FIG. 4, for example, data regarding spark demand voltage can be converted to data that represents a predetermined safety margin. The predetermined safety margin is applied selectively according to the spark demand voltage at different manifold pressures and different engine crank angles BTDC. In FIG. 4, the exemplary safety margin of about 20% is provided by preventing the make voltage from exceeding about 80% of the spark demand voltage. Thus, the maximum safe make voltage for a given manifold pressure and crank angle is defined as about 80% of the spark demand voltage at that manifold pressure and that crank angle. As the spark demand voltage increases, from left to right in FIG. 3 and from a lower manifold pressure to a higher manifold pressure, the maximum safety make voltage permitted by the safety margin increases correspondingly.

The make voltage level (i.e., the voltage across the secondary winding 26 of the ignition coil 18) typically is a linear function of the supply voltage (i.e., the voltage that is applied to the primary winding 24 of the ignition coil 18 to initiate dwell). Thus, for a given supply voltage, it is possible to calculate or otherwise determine the corresponding make voltage level. Such a calculation can be performed by the controller 14. The calculation can be performed arithmetically by the controller 14, or alternatively, can be performed by reference to a supply voltage-related look-up table 29 in the memory 30 of the controller 14.

The exemplary safety margin shown in FIG. 4 can be implemented by the controller 14 in response to the output signal 16 from the manifold pressure sensor (e.g., from the MAP sensor). The controller 14 also can be connected, as is known in the art of ECUs, to a signal 40 indicative of engine crank angle and another signal 42 indicative of supply voltage. In providing the predetermined safety margin, the controller 14 preferably is adapted to delay the start of dwell enough so that the make voltage developed across the secondary winding 24 of the ignition coil 18, upon commencement of dwell, has a predetermined safety voltage level that is less than a spark demand voltage of a spark plug 20 connected to the ignition coil 18, at that pressure.

The controller 14, in this regard, can be adapted so that, at the pressure indicated by the pressure sensor 12, the predetermined safety voltage level is less than or equal to about 80% of the spark demand voltage at that pressure. The controller also can be adapted so that the predetermined safety voltage level remains at about 80%, for example, of the spark demand voltage and varies upwardly and downwardly along with the actual spark demand voltage. The resulting safety margin of about 20% provided by keeping the predetermined safety voltage level at about 80% of the spark demand voltage, however, is only one example of the many possible safety margins that can be implemented in accordance with the present invention. Other safety margins can be implemented, as determined by a system engineer, based on other factors, such as tolerances and future system variations anticipated by the engineer, and based on variables that are unaccounted for during experimentation on the spark demand voltage.

The controller 14 preferably is associated with a memory 30. The memory 30 can be internal or external to the controller 14, as is known in the art. This memory 30 preferably contains a plurality of pressure-related look-up tables 50, each table 50 being associated with a respective value or range of values of the manifold pressure. Each table 50 contains a plurality of safety voltage maximum levels. Each safety voltage maximum level is correlated in each table 50 to an earliest safe crank angle value at which dwell can be commenced without causing the make voltage to exceed the correlated safety voltage maximum level. Each safety voltage maximum level in each table 50 is less than the spark demand voltage by the predetermined safety margin at a respective pressure and at the earliest safe crank angle correlated to that safety voltage maximum level.

The amount of delay provided for each operating condition of the engine and/or the values stored in the various tables 50, can be determined experimentally and/or theoretically. Generally, those values and/or the amount of delay can vary from one engine configuration to another. One approach to determining the correct delay is to experimentally determine the minimum spark demand voltage $V_o$ for a given engine configuration at the lowest achievable manifold absolute pressure $P_o$ and at the earliest possible crank angle $\theta_0$ where the start of dwell can occur on the compression stroke. The change in demand voltage can be assumed to be linear over a relatively small change in pressure, so that angular adjustment as a function of crank angle and MAP would be the solution $\theta-\theta_0$ to the following equation:

$$V_m = P\frac{(1+X)}{P_o/V_o}\left[\frac{(c-1)\left(a(1-\cos\theta_o)+b-\sqrt{b^2-a^2\sin^2\theta_o}\right)+2a}{(c-1)\left(a(1-\cos\theta)+b-\sqrt{b^2-a^2\sin^2\theta}\right)+2a}\right]^{\gamma}$$

where: $a$ = crank throw length (stroke length divided by 2)
$b$ = connecting rod length
$c$ = compression ratio
$\theta$ = crank angle (relative to TDC, compression stroke)
$\gamma$ = ratio of specific heats
$X$ = margin desired between the make voltage and the spark demand voltage (e.g., 0.2 corresponds to 20%)
$P$ = measured intake manifold absolute pressure (*MAP*)
$V_m$ = make voltage for specific coil per cylinder ignition system under conditions sensed by ECU
$P_o$ = *MAP* under the conditions described above
$V_o$ = spark demand voltage under the conditions described above
$\theta_o$ = crank angle under the conditions described above While the controller 14 can be adapted to solve the foregoing equation when an amount of delay is to be calculated, a preferred implementation includes the aforementioned pressure-related tables 50, as well as the look-up tables 29. The controller 14 can be adapted to access, based on the output signal 16 from the manifold pressure sensor 12, one of the tables 50 that corresponds to the present value of the manifold pressure. The controller 14 then can access, within that table 50 and based on the make voltage level calculated by the controller 14 (e.g., based on the supply voltage detected by the controller 14), the earliest safe crank angle value at which dwell can be commenced without causing the make voltage to exceed the correlated safety voltage maximum level.

While the values in the tables 50 can be obtained using the foregoing equation, it is preferable to use additional experimentally determined spark demand voltages to validate the equation and/or to provide the values in the tables 50 based on those experimentally determined spark demand voltages. The experimentally determined spark demand voltages in FIG. 3, for example, were determined using "worst case scenario" settings, as determined by a system engineer. A smaller-than-typical spark plug gap, for example, was used. Each data point was the average minus three standard deviations from 1000 engine cycles.

With reference to FIG. 4, the various data points that correspond to about 80% of the experimentally determined spark demand voltage can be used as safety voltage maximum levels in the tables 50, with intermediate values being interpolated. This can be performed as an alternative or in addition to solving the above equation at several points and interpolating between the points.

It is understood that, depending on the range of variations that could not be accounted for during experimentation, safety margins can be provided that are larger or smaller than the 20% safety margin achieved by data points that are about 80% of the experimentally determined spark demand voltage.

Notably, the various plots in FIG. 4 for each manifold pressure are approximated so that there are no intermediate (or local) maximums or minimums in the plots. This simplifies the algorithm performed by the controller 14 because the controller 14 can simply look for the earliest safe crank angle.

The controller 14 then can prevent initiation of dwell until the crank angle indicated by the earliest safe crank angle value selected by accessing the table 50 using the make voltage level, is reached. Preferably, the controller 14, when accessing the earliest safe crank angle value, is adapted to select from among the safety voltage maximum levels within the selected table 50 (selected based on pressure), a particular one that is greater than and closest to the make voltage level calculated by the controller 14. For manifold pressure values that fall between two tables, the controller 14 can be adapted to interpolate the corresponding maximum safe voltage levels.

The following is an exemplary set of tables 50 based on the experimentally determined maximum safe voltage levels shown in FIG. 4. Each table 50 is represented by one of the vertical columns below:

| EARLIEST SAFE CRANK ANGLE | SAFETY VOLTAGE MAX LEVEL for MAP of 14 kPa | SAFETY VOLTAGE MAX LEVEL for MAP of 22 kPa | SAFETY VOLTAGE MAX LEVEL for MAP of 25 kPa |
|---|---|---|---|
| 180 Degrees BTDC | 0.97 kilovolt | 1.15 kilovolts | 1.30 kilovolts |
| 170 Degrees BTDC | 1.03 kilovolts | 1.15 kilovolts | 1.30 kilovolts |
| 160 Degrees BTDC | 1.10 kilovolts | 1.24 kilovolts | 1.30 kilovolts |
| 150 Degrees BTDC | 1.23 kilovolts | 1.27 kilovolts | 1.40 kilovolts |
| 140 Degrees BTDC | 1.23 kilovolts | 1.36 kilovolts | 1.40 kilovolts |
| 130 Degrees BTDC | 1.23 kilovolts | 1.38 kilovolts | 1.40 kilovolts |
| 120 Degrees BTDC | 1.30 kilovolts | 1.50 kilovolts | 1.55 kilovolts |

Operation of a preferred embodiment of the system of the present invention will now be described using the foregoing data and some exemplary scenarios. Initially, it will be assumed that a vehicle equipped with a controller 14 of the present invention has towed a heavy trailer up a hill. As the vehicle begins to travel on the hill's downward slope, where moderate to heavy engine braking eventually will be used, the conventional dwell time for the exemplary ignition coil is about 4.44 milliseconds with a supply voltage of 14V. The make voltage associated with each such coil 18 is, for example, 1.2 kilovolts with the supply voltage of 14 volts.

While accelerating down the hill but not yet to the desired speed, the MAP is about 22 kPa, and the engine speed reaches 5400 RPM with a 26 degree BTDC spark advance. At this speed, the conventional dwell would cover about 144 crank degrees (i.e., 5400 RPM times 0.00444 seconds times 360 degrees per revolution times 1/60 minute per second). A conventional dwell therefore would commence at about 170 degrees BTDC (i.e., 144 degrees plus the 26 degree advance) to achieve the desired conventional spark advance. However, at 22 kPa, the controller 14 of the present invention determines from the corresponding table 50 above, that the safety voltage maximum level is less than the 1.2 kV make voltage calculated by the controller 14 based on the supply voltage (or obtained from a look-up table 29). The controller 14 therefore determines that a delay should be provided. The first safety voltage maximum level in the table 50 that exceeds the calculated or otherwise determined make voltage level is the 1.24 kilovolt safety voltage maximum level. That particular value corresponds in the table 50 to an earliest safe crank angle of 160 degrees. The exemplary controller 14 of the present invention therefore delays the start of dwell until the crank angle of 160 degrees BTDC is reached. This corresponds to a delay of about 10 degrees.

As the engine speed increases to 6200 RPM, the spark advance can change, for example, to about 30 degrees, while the MAP remains at about 22 kPa. A conventional dwell now would cover about 165 degrees, and the start of a conventional dwell would be at about 195 degrees BTDC. According to the foregoing table 50 associated with a MAP of 22 kPa, however, the dwell cannot start before 160 degrees BTDC. The exemplary controller 14 of the present invention therefore would delay the commencement of dwell by about 35 crank degrees.

When the engine speed reaches 7000 RPM, the conventional spark advance would be, for example, 35 degrees. However, because the throttle has been closed in this exemplary scenario, the MAP drops, for example, to about 14 kPa. At this speed, the conventional dwell might be reduced to 4.16 milliseconds for power dissipation reasons (e.g., to prevent the coil 18 from becoming excessively heated). The resulting 175 degrees of dwell would require the conventional dwell to start at 210 degrees BTDC. Dwell, however, cannot begin until 150 degrees BTDC according to the foregoing table 50 associated with a MAP of 14 kPa. In particular, that table 50 has a safety voltage maximum level of 1.23 kilovolts at a crank angle of 150 degrees BTDC. Proceeding down the table 50, this is the first safety voltage maximum level that is greater than the calculated or otherwise obtained make voltage of 1.2 kilovolts. The crank angle of 150 degrees BTDC therefore represents the earliest crank angle at which dwell can commence in order to maintain the desired safety margin from a spark-on-make condition. The controller 14 therefore institutes a delay on the initiation of dwell corresponding to about 60 degrees of crank shaft rotation.

As the vehicle slows, the engine returns to a speed of 6200 RPM The spark advance at this engine speed is, for example, 31 degrees with a MAP of 14 kPa. In addition, the supply voltage may change from 14 volts to 13 volts. When the supply voltage drops to 13 volts, conventional dwell may require as much as 4.95 milliseconds to reach the same coil charge as when operated with 14 volts of supply voltage. The make voltage exhibits a corresponding decrease. The make voltage may be 1.1 kilovolts, for example, when the supply voltage drops to 13 volts. While the 184 degrees of conventional dwell at the lower supply voltage would require dwell to start at 215 degrees BTDC, the controller 1 of the present invention would delay the start of dwell according to the information in the table 50 associated with a MAP of 14 kPa. In particular, the relevant table 50 indicates that dwell should not start before 160 BTDC when the make voltage level is calculated or otherwise determined to be 1.1 kilovolts. The commencement of dwell therefore is delayed by about 55 degrees of crank angle, by the controller 14 of the present invention.

Notably, all of the foregoing exemplary scenarios where a delay is provided occur when engine performance is not critical. By contrast, when the MAP is high and the engine is operating with the throttle wide open, with little, if any, spark advance, the right side of FIG. 4 indicates that higher make voltages are tolerated without imposing a delay. Thus, in preventing spark-on-make events according to the present invention, engine performance typically is not sacrificed when it is most needed.

From the foregoing description, it becomes readily apparent that the present invention provides a convenient, reliable, a cost-effective system and method for preventing spark-on-make in an internal combustion engine. This is especially desirable in ignition configurations where the spark-on-make problem is most critical, namely, in ignition systems that have an individual ignition coil 18 for every cylinder/spark plug 20.

An exemplary implementation of the method comprises the steps of detecting pressure in an intake manifold, providing an output signal 16 indicative of that pressure, and in response to the output signal 16, delaying initiation of ignition dwell in the ignition coil 18 by a period of time sufficient to avoid spark-on-make.

The pressure, as indicated above, preferably is detected as a manifold absolute pressure (MAP). The step of delaying preferably is performed in such a way that, when pressure increases according to the output signal 16, the magnitude of the delay decreases.

In response to the output signal 16, the step of delaying can be performed by a period of time sufficient to avoid spark-on-make by a predetermined safety margin that, in turn, corresponds to sufficient delay so that a make voltage developed across the secondary winding 26 of the ignition coil 18, upon commencement of dwell, has a predetermined safety voltage level that is less than a spark demand voltage of a spark plug 20 connected to the ignition coil 18, at the pressure indicated by the output signal 16. Preferably, the delay is sufficient so that a make voltage developed across the secondary winding 26 of the ignition coil 18, upon commencement of dwell, has a predetermined safety voltage level that is less than or equal to about 80% (preferably about equal to 80%) of a spark demand voltage of a spark plug 20 connected to the ignition coil 18, at the pressure indicated by the output signal 16.

The step of delaying preferably includes the steps of:

calculating, based on a present value of a supply voltage, a make voltage level that would be developed across a secondary winding 26 of the ignition coil 18 upon connection of the supply voltage to a primary winding 24 of the ignition coil 18;

providing a plurality of tables 50, each table 50 being associated with a respective value or range of values of the pressure and containing a plurality of safety voltage maximum levels, each safety voltage maximum level being correlated in each table 50 to an earliest safe crank angle value at which dwell can be commenced without causing the make voltage to exceed the correlated safety voltage maximum level, each safety voltage maximum level in each table 50 being less than the spark demand voltage by an amount corresponding to the predetermined safety margin at a respective pressure and at the earliest safe crank angle correlated to that safety voltage maximum level;

accessing, based on the output signal 16, one of the tables 50 that corresponds to the present value of the pressure;

accessing, within that table 50 and based on the make voltage level, the earliest safe crank angle value at which dwell can be commenced without causing the make voltage to exceed the correlated safety voltage maximum level; and preventing initiation of dwell until the crank angle indicated by the earliest safe crank angle value selected by accessing the table 50 using the make voltage level, is reached.

Preferably, the step of accessing the earliest safe crank angle value includes the step of selecting from among the safety voltage maximum levels within the pressure-selected table 50, a particular one that is greater than and closest to the make voltage level.

The make voltage level preferably is calculated in a non-arithmetic manner (e.g., by reference to a memory look-up table 29). An exemplary implementation with a memory 30 would include a table 29 of different supply voltage values and a correlated make voltage level associated with each such supply voltage value.

Notably, the system 10 of the present invention can be implemented without requiring more hardware than is already present in many conventional vehicles. The method and system 10 of the present invention, for example, can be implemented by reprogramming the typical ECU so that it includes or becomes the foregoing controller 14. MAP sensors and other forms of intake manifold pressure sensors 12 are already present in many conventional vehicles. The cost of implementing the present invention therefore is substantially limited to the costs associated with initially reprogramming the ECU and implementing reprogrammed versions in future manufacturing. Long-term costs associated with additional parts, such as high voltage diodes, more complex and expensive primary winding driver circuits, and the like, therefore can be avoided when providing a system and method for prevention of spark-on-make according to the present invention.

While the terms "safe", "safety", and "danger" are used in the foregoing description to describe operation of the present invention and/or prior techniques, it will be appreciated that these terms refer to the engine's operability and the invention's ability to prevent a spark-on-make condition detrimental to the engine's operability. These terms do not refer to any risk of personal injury.

While the present invention has been described with reference to certain preferred embodiments and implementations, it is understood that various modifications and variations will no doubt occur to those skilled in the art to which this invention pertains. These and all other such variations which basically rely of the teachings through which this disclosure has advanced the art are properly considered within the scope of this invention.

What is claimed is:

1. A system for preventing spark-on-make in an internal combustion engine, comprising:

a pressure sensor adapted to detect pressure in an intake manifold and provide an output signal indicative of that pressure; and a controller at least indirectly connected to the pressure sensor and adapted to delay initiation of ignition dwell in a coil by a period of time sufficient to avoid spark-on-make, in response to the output signal from the sensor.

2. The system of claim 1, wherein said pressure sensor is a manifold absolute pressure (MAP) sensor.

3. The system of claim 1, wherein said controller is adapted to provide said delay in such a way that, when pressure increases according to the output signal, the magnitude of the delay decreases.

4. The system of claim 1, wherein said controller is adapted to delay initiation of ignition dwell in an ignition coil by a period of time sufficient to avoid spark-on-make by a predetermined safety margin, in response to the output signal from the sensor.

5. The system of claim 4, wherein said predetermined safety margin corresponds to sufficient delay so that a make voltage developed across a secondary winding of the ignition coil, upon commencement of dwell, has a predetermined safety voltage level that is less than a spark demand voltage of a spark plug connected to said ignition coil, at said pressure.

6. The system of claim 4, wherein said predetermined safety margin corresponds to sufficient delay so that a make voltage developed across a secondary winding of the ignition coil, upon commencement of dwell, has a predetermined safety voltage level that is less than or equal to about 80% of a spark demand voltage of a spark plug connected to the ignition coil, at said pressure.

7. The system of claim 4, wherein said predetermined safety margin corresponds to sufficient delay so that a make voltage developed across a secondary winding of the ignition coil, upon commencement of dwell, is about 80% of a spark demand voltage of a spark plug connected to the ignition coil, at said pressure.

8. The system of claim 4, wherein said controller is adapted to calculate, based on a present value of a supply voltage, a make voltage level that would be developed across a secondary winding of the ignition coil upon connection of the supply voltage to a primary winding of the ignition coil;

wherein said controller is associated with a memory, said memory containing a plurality of tables, each table being associated with a respective value or range of values of said pressure and containing a plurality of safety voltage maximum levels, each safety voltage maximum level being correlated in each said table to an earliest safe crank angle value at which dwell can be commenced without causing the make voltage to exceed the correlated safety voltage maximum level, each safety voltage maximum level in each table being less than the spark demand voltage by said predetermined safety margin at a respective pressure and at the earliest safe crank angle correlated to that safety voltage maximum level;

wherein said controller is adapted to access, based on said output signal, one of said tables that corresponds to the present value of said pressure, and to access, within said one of the tables and based on said make voltage level calculated by the controller, the earliest safe crank angle value at which dwell can be commenced without causing the make voltage to exceed the correlated safety voltage maximum level; and wherein said controller is adapted to prevent initiation of dwell until the crank angle indicated by the earliest safe crank angle value selected by accessing said one of the tables using the make voltage level, is reached.

9. The system of claim 8, wherein said memory is internal to the controller.

10. The system of claim 8, wherein said controller, when accessing the earliest safe crank angle value, is adapted to select from among the safety voltage maximum levels within said one of the tables, a particular one that is greater than and closest to said make voltage level calculated by the controller.

11. The system of claim 8, wherein said controller is adapted to calculate said make voltage level in a non-arithmetic manner.

12. The system of claim 8, wherein said controller is adapted to calculate said make voltage level in an arithmetic manner.

13. The system of claim 1, wherein said controller is adapted to calculate, based on a present value of a supply voltage, a make voltage level that would be developed across a secondary winding of the ignition coil upon connection of the supply voltage to a primary winding of the ignition coil, said controller being adapted to provide said delay in a manner dependent upon both said make voltage level and said output signal from the pressure sensor.

14. A method for preventing spark-on-make in an internal combustion engine, said method comprising the steps of:

detecting pressure in an intake manifold;

providing an output signal indicative of that pressure; and delaying initiation of ignition dwell in an ignition coil by a period of time sufficient to avoid spark-on-make, in response to the output signal.

15. The method of claim 14, wherein said pressure that is detected is a manifold absolute pressure (MAP).

16. The method of claim 14, wherein said step of delaying is performed in such a way that, when pressure increases according to the output signal, the magnitude of the delay decreases.

17. The method of claim 14, wherein said step of delaying is performed by a period of time sufficient to avoid spark-on-make by a predetermined safety margin, in response to the output signal.

18. The method of claim 17, wherein said predetermined safety margin corresponds to sufficient delay so that a make voltage developed across a secondary winding of the ignition coil, upon commencement of dwell, has a predetermined safety voltage level that is less than a spark demand voltage of a spark plug connected to said ignition coil, at said pressure.

19. The method of claim 17, wherein said predetermined safety margin corresponds to sufficient delay so that a make voltage developed across a secondary winding of the ignition coil, upon commencement of dwell, has a predetermined safety voltage level that is less than or equal to about 80% of a spark demand voltage of a spark plug connected to the ignition coil, at said pressure.

20. The method of claim 17, wherein said predetermined safety margin corresponds to sufficient delay so that a make voltage developed across a secondary winding of the ignition coil, upon commencement of dwell, is about 80% of a spark demand voltage of a spark plug connected to the ignition coil, at said pressure.

21. The method of claim 17, wherein said step of delaying includes:

calculating, based on a present value of a supply voltage, a make voltage level that would be developed across a secondary winding of the ignition coil upon connection of the supply voltage to a primary winding of the ignition coil;

providing a plurality of tables, each table being associated with a respective value or range of values of said pressure and containing a plurality of safety voltage maximum levels, each safety voltage maximum level being correlated in each said table to an earliest safe crank angle value at which dwell can be commenced without causing the make voltage to exceed the correlated safety voltage maximum level, each safety voltage maximum level in each table being less than the spark demand voltage by said predetermined safety margin at a respective pressure and at the earliest safe crank angle correlated to that safety voltage maximum level;

accessing, based on said output signal, one of said tables that corresponds to the present value of said pressure;

accessing, within said one of the tables and based on said make voltage level, the earliest safe crank angle value at which dwell can be commenced without causing the make voltage to exceed the correlated safety voltage maximum level; and preventing initiation of dwell until the crank angle indicated by the earliest safe crank angle value selected by accessing said one of the tables using the make voltage level, is reached.

22. The method of claim 21, wherein said tables are stored in an electronic memory, and wherein the steps of the method are performed by an electronic engine control unit.

23. The method of claim 21, wherein said step of accessing the earliest safe crank angle value includes the step of selecting from among the safety voltage maximum levels within said one of the tables, a particular one that is greater than and closest to said make voltage level.

24. The method of claim 21, wherein said step of calculating the make voltage level is performed in a non-arithmetic manner.

25. The method of claim 21, wherein said step of calculating the make voltage level is performed in an arithmetic manner.

26. The method of claim 14, wherein said step of delaying includes:

calculating, based on a present value of a supply voltage, a make voltage level that would be developed across a secondary winding of the ignition coil upon connection of the supply voltage to a primary winding of the ignition coil; and delaying initiation of ignition dwell in an ignition coil by a period of time sufficient to avoid spark-on-make, in response to the output signal and the make voltage level.

27. A system for preventing spark-on-make in an internal combustion engine, said system comprising:

means for detecting pressure in an intake manifold and providing an output signal indicative of that pressure; and means for delaying initiation of ignition dwell of an ignition coil by a period of time sufficient to avoid spark-on-make, in response to the output signal.

28. The system of claim 27, wherein said means for detecting pressure is a manifold absolute pressure (MAP) sensor.

* * * * *